US006493973B1

(12) United States Patent
Nelson

(10) Patent No.: US 6,493,973 B1
(45) Date of Patent: Dec. 17, 2002

(54) BANNER HOLDER

(76) Inventor: Ned H. Nelson, 12356 Northup Way, Suite 109, Bellevue, WA (US) 98005

( * ) Notice: Subject to any disclaimer, the term of this patent is extended or adjusted under 35 U.S.C. 154(b) by 0 days.

(21) Appl. No.: 09/452,509

(22) Filed: Dec. 1, 1999

Related U.S. Application Data

(60) Provisional application No. 60/110,962, filed on Dec. 4, 1998.

(51) Int. Cl.[7] ..... G09F 15/00; G09F 7/02

(52) U.S. Cl. ..... 40/607; 40/611

(58) Field of Search ..... 40/603, 604, 606, 40/607, 611; D20/41

(56) References Cited

U.S. PATENT DOCUMENTS

| | | | | | |
|---|---|---|---|---|---|
| 967,490 | A | * | 8/1910 | Bell | 40/607 X |
| 2,942,366 | A | * | 6/1960 | Pfaff, Jr. et al. | 40/624 |
| 3,034,242 | A | * | 5/1962 | Gold | 40/604 |
| 3,263,356 | A | * | 8/1966 | Gilmoure et al. | 40/604 |
| 3,310,899 | A | | 3/1967 | Hart et al. | 40/125 |
| 3,495,346 | A | | 2/1970 | Gilmoure | 40/128 |
| 3,550,297 | A | * | 12/1970 | Friedrichsen | 40/603 |
| 3,581,420 | A | | 6/1971 | Mollet et al. | 40/125 |
| 3,609,894 | A | | 10/1971 | Miller | 40/145 R |
| 3,675,356 | A | | 7/1972 | Gilmoure | 40/145 |
| 3,726,035 | A | | 4/1973 | Bower et al. | 40/125 G |
| 3,982,345 | A | | 9/1976 | Coleman | 40/132 R |
| 4,095,360 | A | * | 6/1978 | Dinan et al. | 40/603 |
| 4,730,803 | A | | 3/1988 | Hillstrom | 248/297.2 |
| 5,263,675 | A | | 11/1993 | Roberts et al. | 248/219.4 |
| 5,335,889 | A | | 8/1994 | Hopkins et al. | 248/231 |
| 5,428,913 | A | | 7/1995 | Hillstrom | 40/604 |
| 6,192,611 | B1 | * | 2/2001 | Molla | 40/603 X |

FOREIGN PATENT DOCUMENTS

| | | | |
|---|---|---|---|
| DE | 4112390 | * 10/1992 | 40/607 |

* cited by examiner

*Primary Examiner*—Brian K. Green
(74) *Attorney, Agent, or Firm*—Garrison & Assoc. PS; David L. Garrison

(57) ABSTRACT

A novel and improved banner holder for displaying easily exchangeable signs, flags, and other banners with extreme structural simplicity and a minimum of moving parts. The banner holder comprises a support member, at least two mounting members, and an interchangeable brace adapted to hold the banner. The ends of the brace are adapted to engage the mounting members in such fashion as to make the brace, and the banner mounted on it, easily mountable, removable, and replaceable. A preferred embodiment comprises a substantially vertical stationary support member, a pair of mounting members disposed on the support member, and a brace adapted to hold the banner and to engage the mounting members, the brace being easily and surely attached to the support member by inserting one end of the brace into one or more holes in one of the mounting members, aligning a second end of the brace with a hole or holes in a second mounting member, and inserting the second end of the brace into the hole(s) in the second mounting member until a stop member proximate the second end of the brace is engaged by the mounting member.

4 Claims, 5 Drawing Sheets

FIG. 5
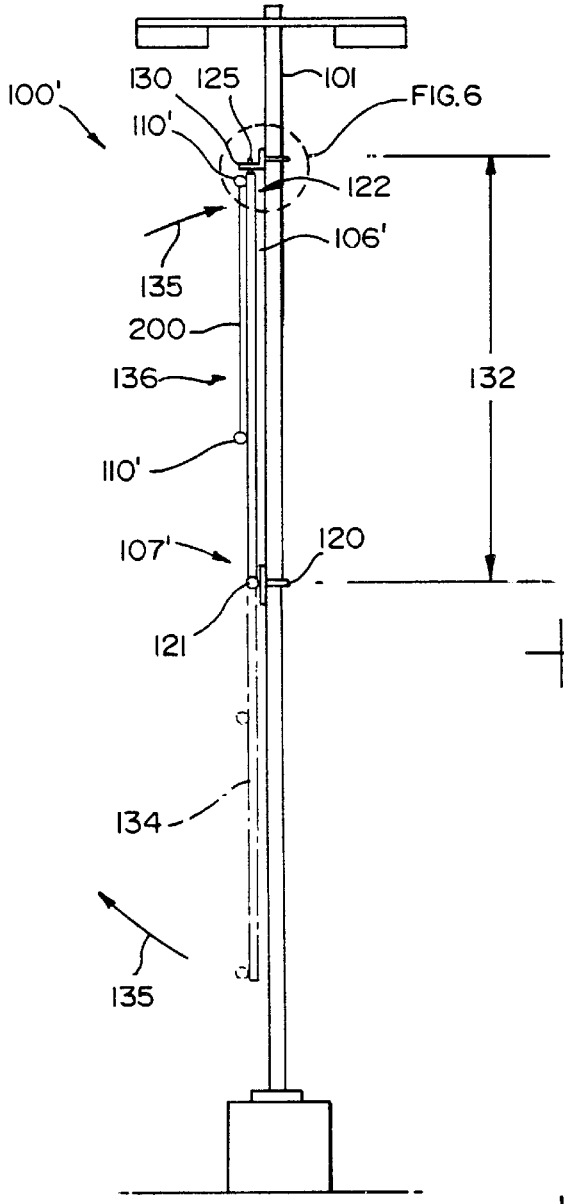
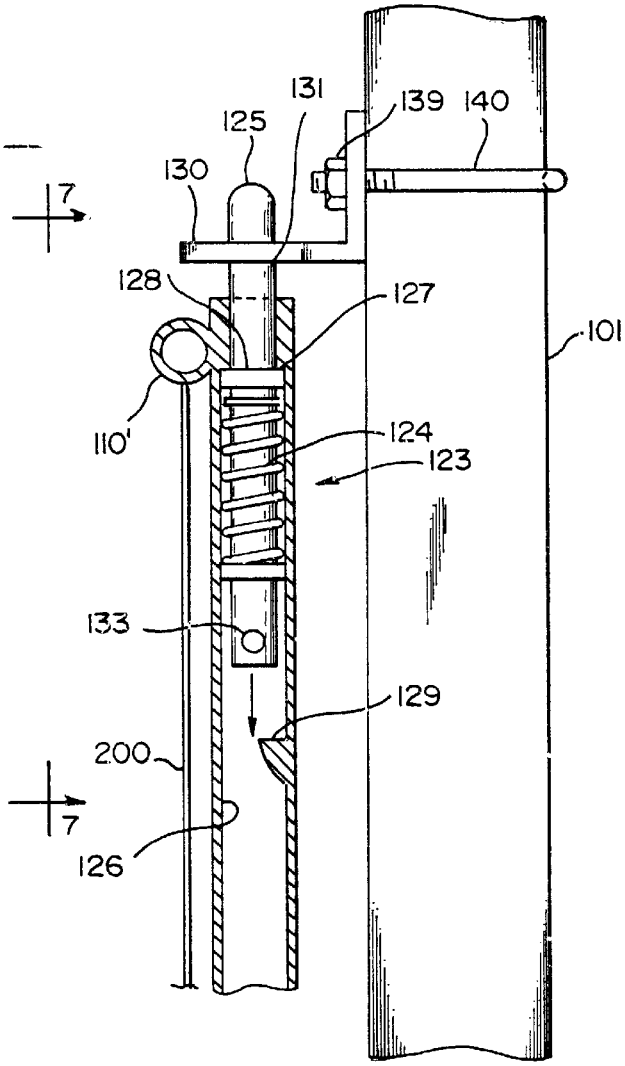
FIG. 6

BANNER HOLDER

This application claims the benefit of U.S. Provisional Application Ser. No. 60/110,962, entitled Banner Holder, and filed Dec. 4, 1998.

TECHNICAL FIELD

The invention relates to holding fixtures, and more particularly to an improved banner and sign display device.

BACKGROUND OF THE INVENTION

It has long been human practice to display pictures and other information on banners, and to mount the banners on structures for convenience in viewing. Frequently banners have been mounted on free-standing or otherwise dedicated structures which hold them up in straight, flat, or unfolded condition to make them easier to read and see. It is of critical importance that such banner holding structures be sturdy, durable, and easy and simple to use and erect. It is convenient if such structures allow banners to be installed, removed, and replaced easily.

A number of attempts at making simple and effective banner holders have been tried. While each represents an advance, they are also each more complicated to construct and less simple to install and/or remove than is necessary. For example, U.S. Pat. No. 5,335,889 to Hopkins et al.; U.S. Pat. No. 5,263,675 to Roberts et al,; U.S. Pat. No. 5,428,913 to Hillstrom; U.S. Pat. No. 3,310,899 to Hart et al.; U.S. Pat. No. 3,609,894 to Miller; U.S. Pat. No. 3,726,035 to Bower et al.; and U.S. Pat. Nos. 3,675,356 and 3,495,346 to Gilmoure all disclose banner suspension systems requiring access to the upper end of the banner and therefore some ladder or lift for access during installation. The systems they disclose are relatively complicated and permanent, and require somewhat complex work to replace or remove.

Another attempt is shown in U.S. Pat. No. 3,581,420 to Mollet et al., which discloses a pole sign construction in which the upper end of a pole sign is hung from simple hooks attached to a pole support member. Again, hanging of the pole sign thus requires access to the upper end of the sign, as for example by means of a ladder or hydraulic lift.

U.S. Pat. No. 4,730,803 to Hillstrom discloses a ground access elevated pole banner which reduces the need for ladders or hydraulic lifts but relies upon a relatively complicated track system secured to the side of a pole support member.

Thus although several systems have been disclosed, there remains a need for a simple, secure, and effective means for suspending and displaying banners, flags, and other large means for exhibiting information. There is a further need for such systems which allow for the easy installation, removal, and replacement of banners for viewing.

DISCLOSURE OF THE INVENTION

Accordingly, it is an object of the invention to provide a simple, secure, and effective means for suspending and displaying banners, flags, and other large means for exhibiting information. It is a further object of the invention to provide such systems which allow for the easy installation, removal, and replacement of such banners for viewing.

The invention provides such a system. The invention represents a novel and improved banner holder for displaying easily exchangeable signs, flags, and other banners with extreme structural simplicity and a minimum of moving parts. In general, the banner holder according to the invention comprises a support member, at least two mounting members, and an interchangeable brace adapted to hold the banner. The ends of the brace are adapted to engage the mounting members in such fashion as to make the brace, and the banner mounted on it, easily mountable, removable, and replaceable.

In its most basic form, the apparatus aspect of the invention provides a banner holder for holding a banner in a display position, the holder comprising a support member, first and second mounting members, and a brace adapted to retain a banner and to hold the banner spread out for display, typically in a flat or quasi-flat (e.g., a smoothly curved) condition for viewing or reading. The brace has first and second ends, each of which is adapted to engage one of said mounting members, and the first and second mounting members disposed upon the support member at a distance from each other sufficient to allow the mounting members to be simultaneously and reasonably engaged by the brace ends, such that said brace may be supported on said support member and thereby hold said banner in a display position. The mounting and removal of banners from a structures of this type, and in particular of each of the types described herein, in the manner herein described, is remarkably simple. Yet the system provides a very secure mounting well adapted to the efficient display of banners, etc. Moreover, by supplying a banner holder with a series of two or more braces, each with an attached banner, the replacement or rotation of banners and their associated messages, etc., may be very quickly and easily accomplished.

A preferred embodiment of the apparatus aspect of the invention comprises a substantially vertical stationary support member, a pair of mounting members disposed on the support member, and a brace adapted to hold the banner and to engage the mounting members, the brace being easily and surely attached to the support member by inserting one end of the brace into one or more holes in one of the mounting members, aligning a second end of the brace with a hole or holes in a second mounting member, and inserting the second end of the brace into the hole(s) in the second mounting member until a stop member proximate the second end of the brace is engaged by the mounting member. An alternative embodiment comprises a brace which is hinged at one end and comprises a spring-loaded detent at the other, the brace being rotated into contact with a mounting means disposed upon the support member. As the brace is rotated into position a banner attached to the brace is moved into a display position so that it may be viewed.

Thus in one aspect the invention provides a banner holder for holding a banner in a display position, the holder comprising a support member; first and second mounting members, each including at least one detent receiving aperture; and a brace adapted to hold a banner. The brace includes two ends, one or more frame members adapted to engage one or more ends or edges of the banner and thereby to hold the banner in a substantially flat disposition on the brace, and a mounting stop. The brace is longer than the distance between said mounting holes and includes at each said end a detent adapted to be received within one of the detent receiving apertures in the mounting members. Preferably, one of the ends of the brace includes a retention means adapted to prevent the brace from being withdrawn from the receiving apertures. In such embodiments of the invention the second mounting member is disposed on the brace at a distance from the first mounting member sufficient to allow the first end of the brace to be placed in the detent receiving aperture in the first mounting member and inserted thereinto to an extent sufficient to allow the second end of the brace to be aligned with and placed in a detent receiving aperture in the second mounting member, such that when the second end of the brace is inserted into the detent receiving aperture in the second mounting member to an extent sufficient for the mounting stop to engage the second mounting member, the first end of the brace is retained within the detent receiving aperture in the first mounting member.

Preferred embodiments of this aspect of the invention further comprise a retention means adapted to prevent the brace from being withdrawn from the mounting holes or detent receiving apertures in the mounting members. Most preferably, this retention means comprises a hole disposed in one of the ends of the brace (typically the lower end is most convenient to reach) and a retaining pin adapted to be received in the hole and hold the brace in place. As an example, drilling a hole through an end of the brace after it has passed through its mounting member and the mounting stop has been engaged to hold the brace in place, and placing a common combination lock or padlock through the hole provides a relatively simple, certain, and secure means for securing the brace.

In another aspect the invention provides a banner holder for holding a banner in a display position, the holder comprising a support member, a first mounting member, and a second mounting member, the second mounting member having a detent catch or detent receiving aperture adapted for releasable engagement of a displaceable biased detent, and a brace which is again adapted to hold a banner. The brace has first and second ends, the first end being rotatably attached to the first support member and the second end being free. The free end of the brace includes a displaceable biased detent adapted for releasable engagement of the detent catch or aperture in the second mounting member. In preferred embodiments, the biased detent includes a release mechanism, such that the free end of the brace may conveniently be released from the detent catch or detent receiving aperture. The first and second mounting members of such embodiments of the invention are disposed upon the support member at a distance from each other sufficient to allow the biased detent in the second end to engage the detent catch when said brace is rotated about said first mounting member and said biased detent is thereby brought into contact with said detent catch, whereby, when the brace is rotated about the first support member such that the free end is moved toward the second mounting member, the displaceable biased detent may reasonably engage the catch and the brace member may thereby be held in a display position or conveniently removed therefrom, so that the banner may be viewed and/or removed or replaced.

As will appear from the disclosure herein and in the Figures, banner holders according to the invention provide an extremely simple, secure, and effective means for suspending and displaying banners, flags, and other large means for exhibiting information. They also provide systems which allow for the easy installation, removal, and replacement of banners for viewing.

BRIEF DESCRIPTION OF THE DRAWINGS

FIG. 5 is a schematic side view of an alternative preferred embodiment of a banner holder according to the invention.

FIG. 6 is a schematic side view of a detail of an alternative preferred embodiment of a banner holder according to the invention, taken as indicated from FIG. 5.

BEST MODE OF CARRYING OUT THE INVENTION

Figure 1:
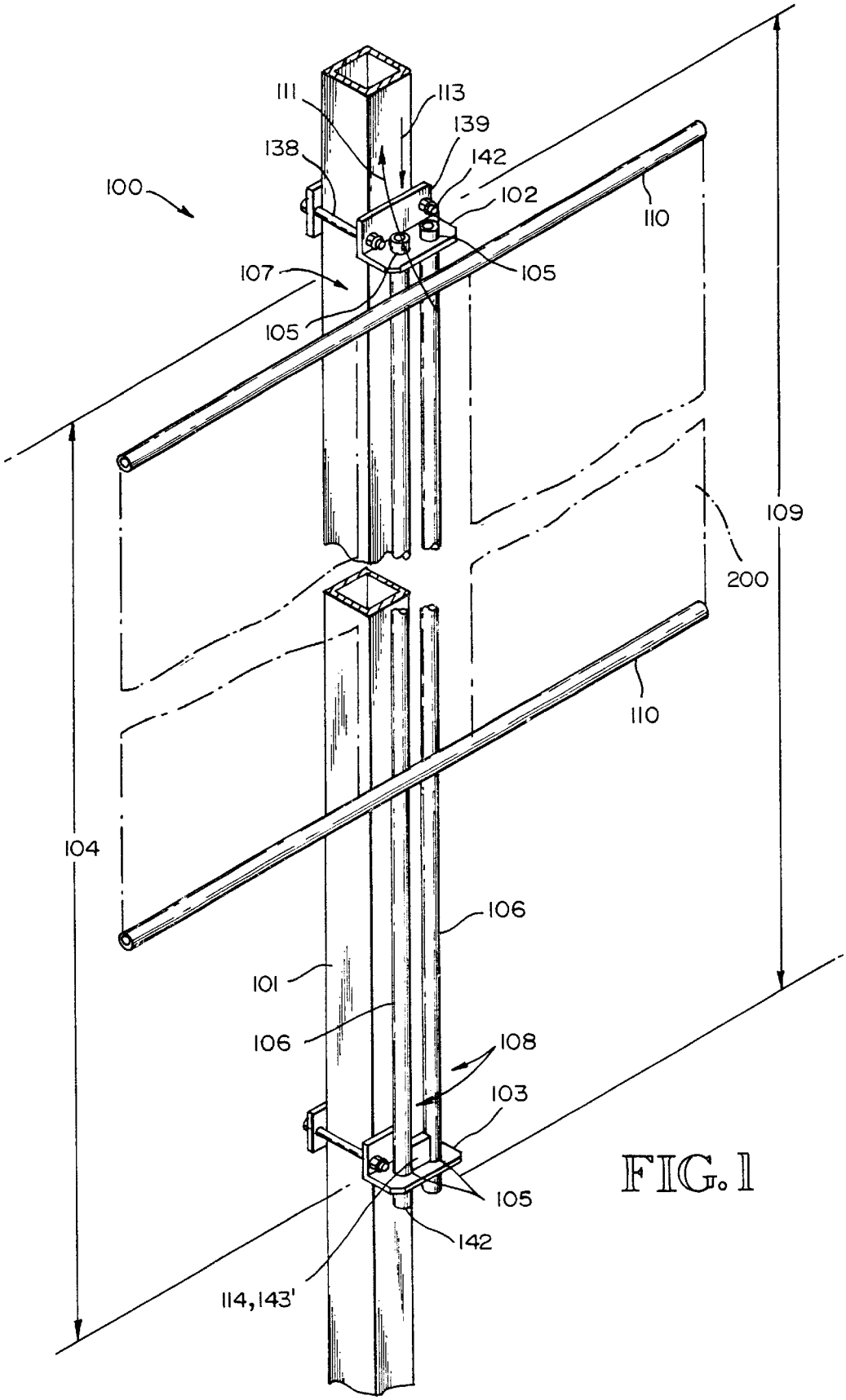
FIG. 1 is a schematic front perspective view of a preferred embodiment of a banner holder according to the invention.

Turning now to the drawings, the invention will be described in a preferred embodiment by reference to the numerals of the drawing figures wherein like numbers indicate like parts.

FIG. 1 is a schematic front perspective view of a preferred embodiment of a banner holder according to the invention. Banner holder 100 comprises support member 101, mounting members 102 and 103, two braces 106, and optionally distinct frame members 110 which support banner 200. Support member 100 serves to hold the banner and the remaining parts of the banner holder in a position in which banner 200 may be displayed, as for example by standing in a substantially vertical position at a distance above the ground sufficient to support the banner within the view of a passing viewer. Such a position is referred to herein as a display position, and comprises any position adapted for the display of the banner, as for example a substantially flat, extended disposition approximating the planar or a smoothly curved surface, which allows for viewing of a substantial portion of the banner. Thus the primary function of the support member is to hold first mounting member 102 and second mounting member 103 a sufficient distance apart and with sufficient strength to permit them to perform their job of supporting brace 106. Any means of holding the support member in place, and any support member orientation, which will allow it to accomplish these purposes will serve. For example, the support member may be held in place by a number of folding legs, like a portable music stand, or by a heavy block (e.g. concrete) attached to its bottom, or it may be sunk permanently into the ground or other foundation. Similarly, instead of comprising a single upright member, the support member may comprise two or more horizontal (or otherwise oriented) members adapted to hold mounting members 102 and 103 in place and a suitable distance apart for the purposes described herein.

Figure 7:
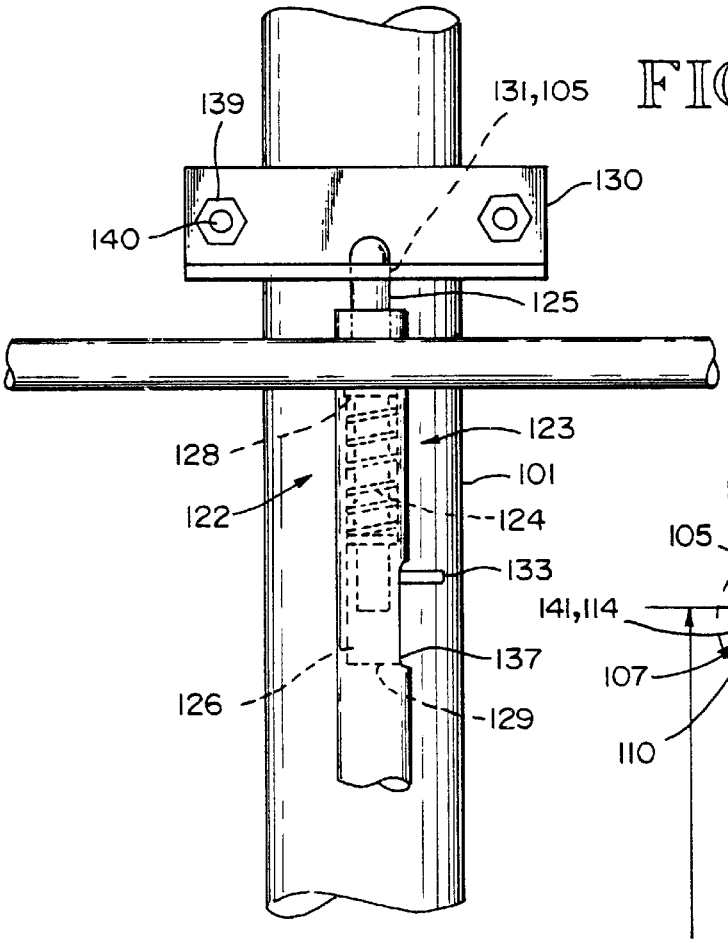
FIG. 7 is a schematic front view of a detail of an alternative preferred embodiment of a banner holder according to the invention, taken along view 7—7 in FIG. 6.
Figure 8:
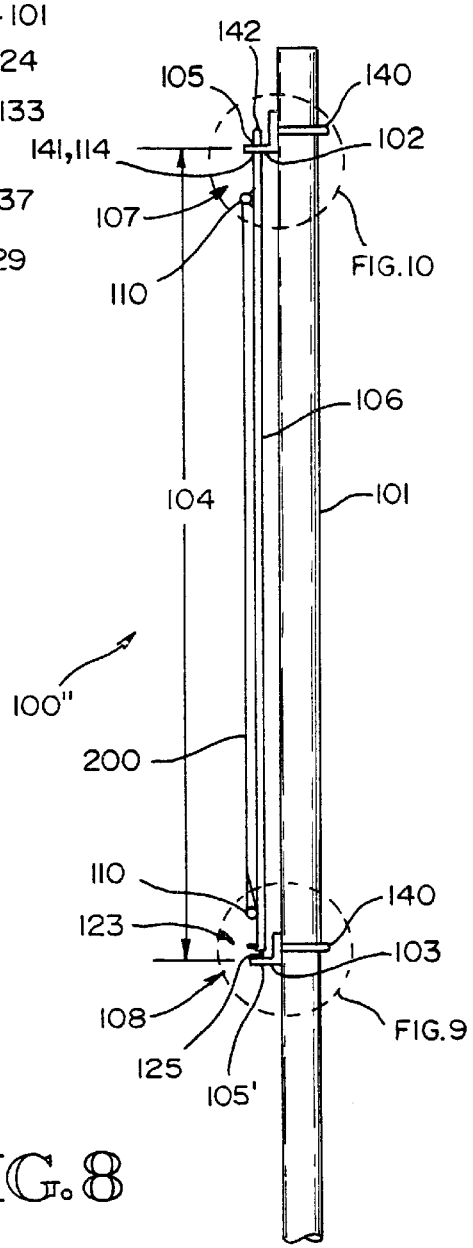
FIG. 8 is a schematic partial side view of an alternative preferred embodiment of a banner holder according to the invention.
Figure 9:
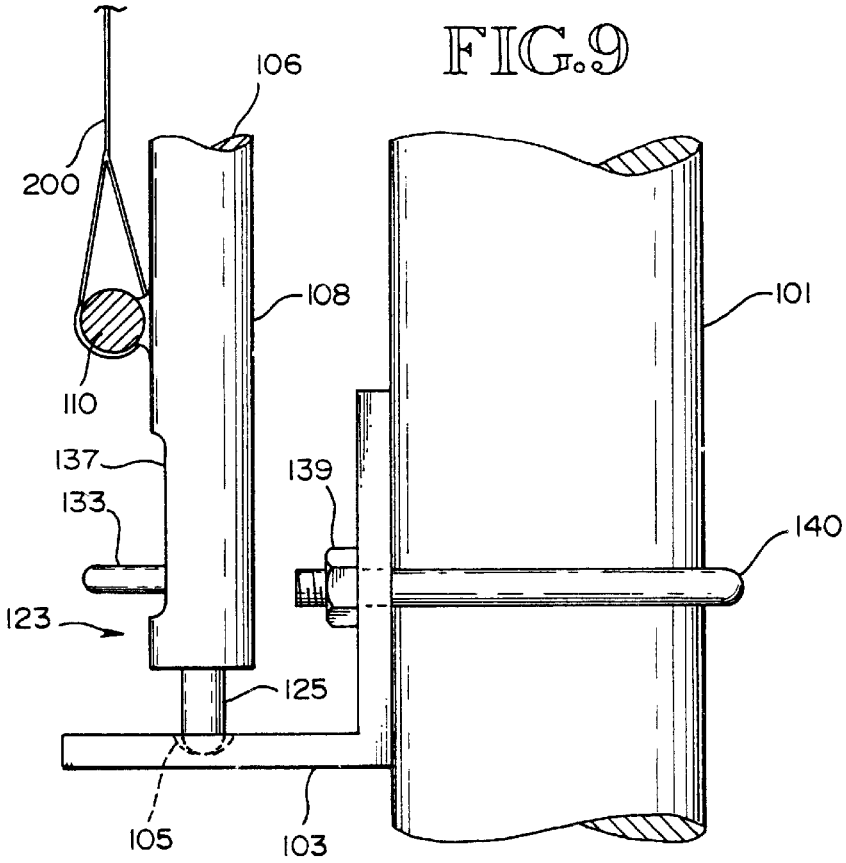
FIG. 9 is a schematic side view of a detail of an alternative preferred embodiment of a banner holder according to the invention, taken as indicated from FIG. 8.
Figure 10:
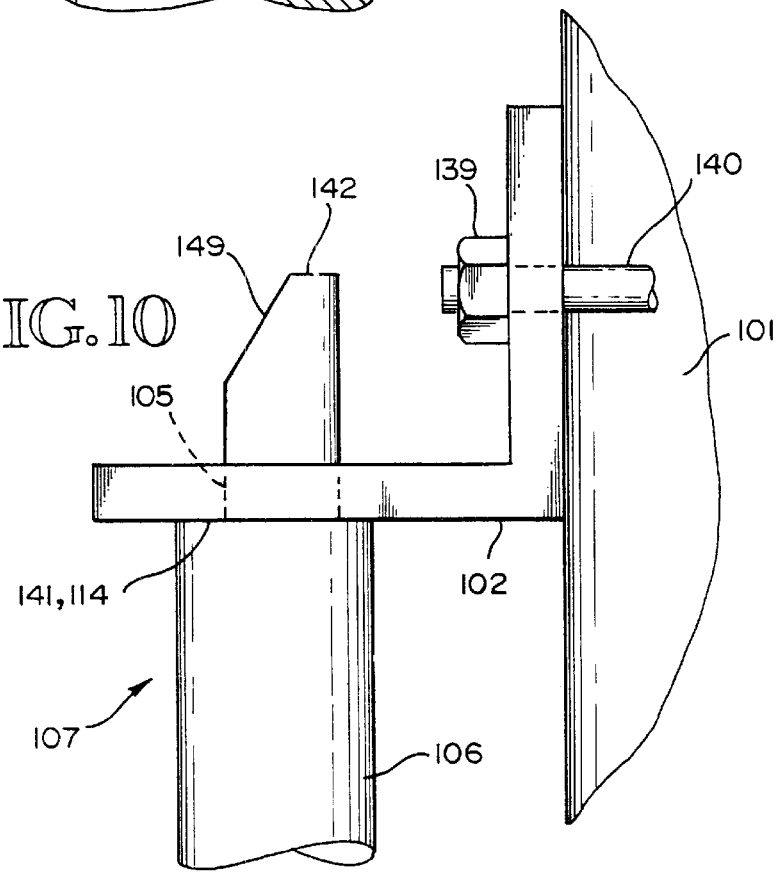
FIG. 10 is a schematic side view of a detail of an alternative preferred embodiment of a banner holder according to the invention, taken as indicated from FIG. 8.

Mounting members 102 and 103 are attached, fixedly but preferably removably, to support 101 by any suitable means, as for example by means of bolts 138 and nuts 139 as shown in FIGS. 1–4 or U-bolts 140 and nuts 138 in FIGS. 6 and 7, and comprise at least one detent receiving aperture or mounting hole 105 for each brace 106. The mounting members serve to support brace (or braces) 106 as herein described, and may comprise either separate, distinct parts or be integral parts of the support member. The Figure depicts two brace members 106; however, by appropriate shaping of the brace members 106 and of holes or apertures 105 (for example, by making them square or otherwise non-circular) as few as one may be used. The use of two brace members in the configuration shown provides superior support for frames 110 and therefore for the banner, especially by increasing torsional strength of the support about an axis parallel to the support member. Each brace 106 has a first end 107, a second end 108, and a length 109 which is greater than that of distance 104 between the mounting members. Most preferably, each brace 106 further comprises a stop 114 adapted to curtail insertion of one of the detents at the ends of the brace into its respective receiving aperture. Such stops may take the form of shoulders at the ends of the brace, as shown in FIGS. 8–10, or of gussets 143 between brace members, as shown in FIGS. 1 through 4, or any other form suitable for the purposes disclosed herein.

Frame members 110 serve to support banner 200 and may take any numbers and form suitable for the accomplishment of that purpose. They need not even exist as distinct members, but may in some circumstances—depending upon the shape and orientation of the banner, the braces, and the support member—even form an integral part of brace 106 itself. Most typically, the frame members are adapted to support the periphery of a banner such that the banner may be spread out into a partially or substantially planar position for viewing and display. In the embodiment shown, two (upper and lower) frame members 110 in the form of horizontal bars are attached to both braces 106 adapted to engage the upper and lower peripheries of a banner and thus to support the banner in a substantially flat disposition. In this embodiment frame members 102 are particularly well suited to the simple and efficient replacement and removal of banners from the frames themselves, thus supplementing the purpose and function of the brace members in permitting rapid removal and replacement of banners through the use of distinct banners mounted on separate braces.

The banner holder according to this aspect of the invention is assembled by attaching a banner to brace or braces 106, either directly or indirectly by means of frame members 110, inserting first ends 107, which comprises detents 142, of the braces into mounting holes or detent receiving apertures 105 in first mounting member 102, sliding the brace(s) into the hole(s) in the direction of arrow 111 far enough to permit second ends 108 and detents 142 of the braces to be aligned with holes or apertures 105 in second mounting member 103, and inserting second detents 142 on ends 108 into the holes by moving the brace in the direction of arrow 113. In embodiments employing one or more mounting stops 114, the brace is moved in the direction of arrow 113 until the brace is secure or until stop 114 contacts a mounting member (in the embodiment shown, the second mounting member). In optionally preferred embodiments frame 110 can serve as a stop member at either the first or second ends of the brace member(s), either as the sole stop member or in addition to stop 114. Similarly, a shoulder or ring appropriately spaced from the end of the brace may serve as well, for example as shown by shoulder 141 in FIGS. 8 and 9.

Figure 2:
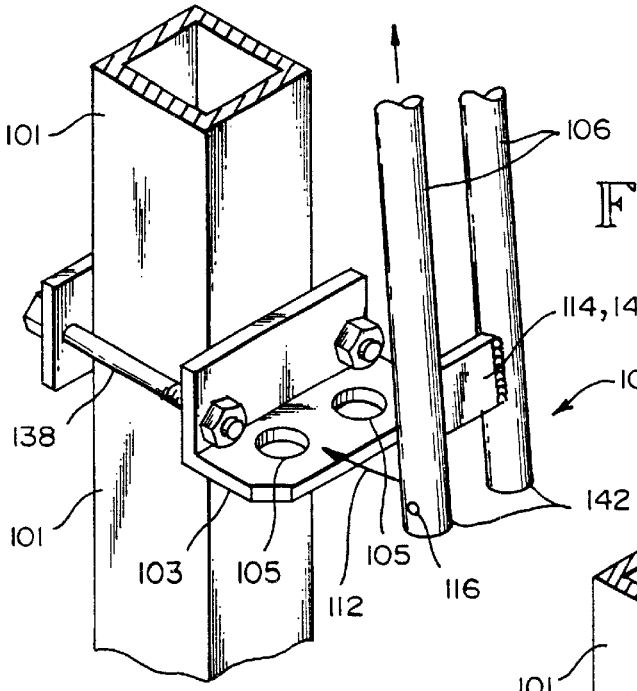
FIG. 2 is a schematic front perspective view of a detail of a preferred embodiment of a banner holder according to the invention.
Figure 3:
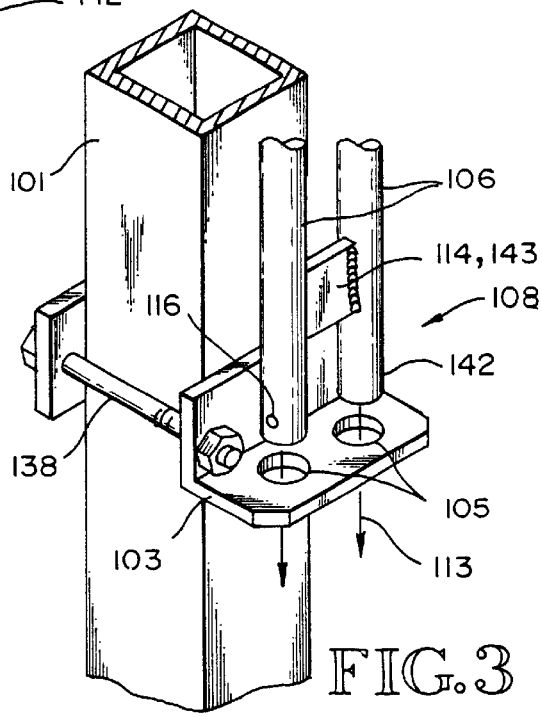
FIG. 3 is a schematic front perspective view of a detail of a preferred embodiment of a banner holder according to the invention.
Figure 4:
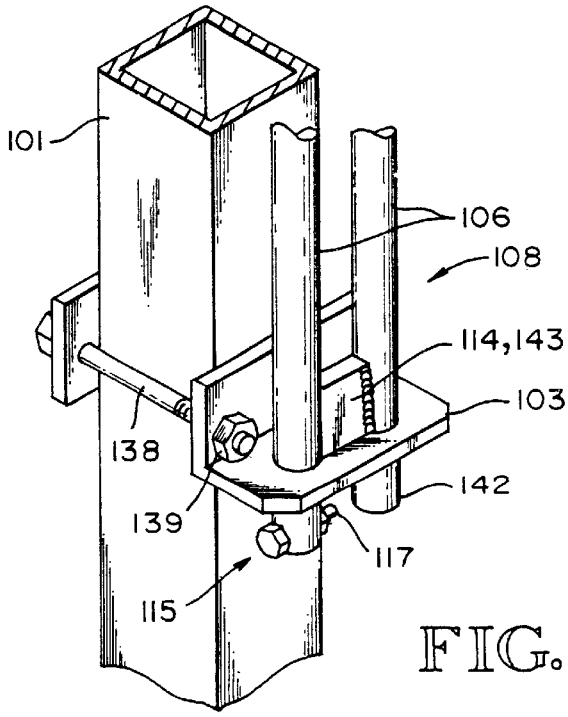
FIG. 4 is a schematic front perspective view of a detail of a preferred embodiment of a banner holder according to the invention.

Insertion of second end 108 of the brace member in holes 105 of the second mounting member is detailed in FIGS. 2 through 4. Once the first end of the brace has been inserted as described in the first mounting member, second end 108 of the brace is aligned with hole 105 by moving the second end in the direction of arrow 112. Upon being aligned with the hole, second end 108 is inserted therein until stop 114 comes into contact with second mounting member 103.

The banner is removed from the holder by simple reversal of the process described. Thus it may readily be seen that by preparing two or more brace-banner sets or combinations, banners may be changed or replaced within a manner of moments.

Preferred embodiments of the invention further comprise a retention means adapted to prevent the brace from being withdrawn from the mounting holes in the mounting members. Any suitable means may be used for this purpose. One such means is shown in FIGS. 2 through 4. Retention means 115 comprises retention hole 116 in second end 108 of the brace, at a location outside second mounting member 103 and preferably on the opposite side of the mounting member from stop 114 when the brace member is in place, as shown in FIG. 4; and retaining pin 117. Once the brace member has been placed in the display position (i.e. with its ends in place in the two mounting members, as described), retaining pin 117 is place in retention hole 116 and secured as desired. For example, if there is a significant risk of undesired removal of the banner from the support member, a conventional pad lock may be used as the retaining pin. Otherwise, a simple pin, a cotter pin, or a bolt will serve.

Although as has been previously described a banner holder according to the invention may be employed either in the vertical orientation shown in the Figures, in a horizontal orientation, or in any other desired orientation, a particular advantage of employing it in the vertical orientation shown is that it is held quite securely in place, once the brace has been mounted, by the force of gravity. In those embodiments of the invention comprising the retention means described herein, use of the retention means in conjunction with a stop, as described, provides a very secure assembly.

A further optional feature of preferred embodiments of the invention is chamfering on the first or second ends of the brace members, such as chamfer 149 in FIG. 10, to facilitate easy insertion of the first end in apertures 105 in the mounting member.

FIGS. 5, 6, and 7 are schematic views of an alternative preferred embodiment of a banner holder according to the invention. Banner holder 100' comprises support member 101, first mounting member 120, second mounting member 130, brace member 106', and optionally distinct Same members 110'. Mounting members 120 and 130 are disposed at a distance 132 from each other upon support member 101. Brace member 106' comprises first end 107' and second or free end 122. First end 107' of the brace member is rotatably, and optionally removably, attached to first mounting member 120, as for example by means of permanent or removable hinge 121. Free end 122 of the brace member comprises displaceable biased detent means 123 in tube, hollow, shaft, bore, or channel portion 126. In the embodiment shown, displaceable biased detent 123 comprises spring 124, pin 125, shoulder 127, and stops 128 and 129; however, spring- or otherwise displacably biased detents are well known in a variety of the mechanical arts, and any construction adaptable to the purposes described herein will serve. In general, a pin or catch is biased to engage a hole or catch or other aperture or catch means in the second mounting member, so as to hold the brace member and thus a banner in an "opened" or display position when the free end of the brace member is rotated into contact with the mounting member. Thus second mounting member 130 comprises a hole or catch adapted to engage detent 123 when the brace member is rotated into the display position. In the embodiment shown, mounting member 130 comprises catch or detent receiving aperture or mounting hole 131. First and second mounting members 120 and 130 are spaced sufficiently far apart so that when brace member 106' is rotated into the display position, displaceable biased detent means 123 is positioned to engage hole or catch 105 in second mounting member 130 so that the brace member is held in the desired position. Typically, then, displaceable detent means 123 is biased so that a detent member such as pin 125 is held in an extended position to engage the hole or catch, as shown in the Figures. It is also generally preferred that biased detent means 123 comprise a release mechanism, so that the free end of the brace member may be disengaged from the second mounting member and the brace and/or banner returned from the display position into a storage or disassembly or non-display position.

Operation of the banner holder according to this aspect of the invention is illustrated in FIGS. 5, 6 and 7. In FIG. 5 brace member 106' is shown in assembly/disassembly or non-display position 134 in broken outline. In this position brace 106' is attached to support 101 and/or mounting member 120, as for example by bolting or hanging by any conventional means a hinge, pin, or other rotating attachment attached to first end 107' of the brace member in place. Banner 200 is attached to brace member, either directly or indirectly by use of frame members 110'. In either case, the banner is attached by use of hems or other conventional attachment means. Once the banner has been attached and brace member is securely but rotatably attached to the support member, the brace member is rotated in the direction of arrows 135 into display position 136, as shown in solid outline. As free end 122 of the brace reaches the display position, pin 125 of displaceable biased detent member 123 comes into contact with second mounting member 130; further movement of the brace compresses pin 125 away from its preferred position and into biasing means 124 until the brace is aligned with hole or catch 131, at which point pin 125 is released and moves into hole 131, thus securing the brace in the display position.

Preferred embodiments of this aspect of the invention further comprise means for disengaging the detent means from the aperture or catch means in second mounting member 130. For example, detent means 123 can comprise release pin 133, which is attached to the detent means and protrudes from the free end of the brace member through slot 137 as shown in FIGS. 6 and 7. By use of a proper hook or other means to engage the release pin, the detent means may be displaced from its biased position so that it disengages catch means 131 to release the brace member. A particularly preferred release mechanism comprises a release pin such as pin 133 shown in those Figures with a pole-mounted hook or release of the type commonly used to close windows above simple arms' reach.

As will appear to those familiar with the art of standard making and banner display, particulars such as the cross sections of the various components described herein are largely immaterial. For example, the support, brace, and frame members may be of circular, square, or other common cross-sectional shape, solid, tubular, or hollow, or of any other section not inconsistent with the purposes described herein Likewise, while generally preferred embodiments of the invention are fabricated from metal, wood, or plastic materials, such as steel, aluminum, or polyvinyl chloride (PVC), any materials of sufficient strength, durability, and corrosion-resistant properties for specific applications will serve, the proper selection of such materials being well within the skill of ordinary designer of such systems.

In FIGS. 8 through 10 a further alternative embodiment of the invention is shown. Brace 106 comprises first end 107, which includes detent 142, and second end 103, which includes spring-loaded biased displaeable detent 123. Both ends are free. Detent 142 has been inserted through detent receiving aperture 105 in first mounting member 102 in the manner described above, until shoulder or stop 114 has contacted mounting member 102, at which point second end 108 of the brace has been rotated toward support member 101, so that detent pin 125 has contacted detent receiving aperture 105' in second mounting member 103. In the case depicted, detent receiving aperture 105' comprises a semi-spherically shaped bowl in the second mounting member. Displacement of detent pin 125 allows brace 106 to move into alignment between the mounting members, whereupon the release of pin 125 causes displaceable detent 123 to hold second end 108 of the brace in place, thus securing brace 106 on the support member and permitting banner 200 to be held in a display position. Activation of the release mechanism by pushing release pin 133 upward away from second end 108 of the brace allows the brace and its attached banner to be removed from the holder.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The invention provides improvements for holding fixtures, and more particularly for banner and sign display devices. In particular, the invention provides secure simplified means for permanent or temporary mounting and display of banners and other devices.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A banner holder for holding a banner in a display position, the holder comprising a support member;

a first mounting member;

a second mounting member; and a brace adapted to retain a banner, said brace having first and second ends, each end adapted to engage one of said mounting members;

said first and second mounting members disposed upon the support member at a distance from each other sufficient to allow said mounting members to be simultaneously engaged by said brace ends, such that said brace may be supported on said support member and thereby hold said banner in a display position;

said mounting members each include at least one detent receiving aperture;

said first and second brace ends comprise detents adapted to be received by said apertures, said brace further comprises a mounting stop, and said brace is longer than the distance between said detent receiving apertures; and said second mounting member is disposed upon the brace at a distance from the first mounting member sufficient to allow the first end of the brace to be placed in said detent receiving aperture in the first mounting member and inserted thereinto to an extent sufficient to allow the second end of the brace to be aligned with and placed in said detent receiving aperture in the second mounting member;

said brace including at least one frame member adapted to engage an end of said banner and thereby to hold said banner in a substantially flat disposition on said brace; and whereby, when said second end of said brace is inserted into the detent receiving aperture in said second mounting member to an extent sufficient for said mounting stop to engage one of said mounting members, the first end of the brace is retained within said detent receiving aperture in said first mounting member.

2. The banner holder of claim 1, wherein an end of said brace includes a retention means adapted to prevent the brace from being withdrawn from the detent receiving apertures in said mounting members.

3. The banner holder of claim 2, wherein said retention means includes a hole disposed in said brace and a retaining pin.

4. A banner holder for holding a banner in a display position, the holder comprising:

a support member;

a first mounting member and a second mounting member, each mounting member having at least one detent receiving aperture; and a brace adapted to hold a banner, said brace having first and second ends, at least one frame member adapted to engage an end of said banner and thereby to hold said banner in a substantially flat disposition on said brace, and a mounting stop, said brace being longer than the distance between said detent receiving apertures and having at each said end a detent adapted to be received within one of said detent receiving apertures, one of said ends having a retention means adapted to prevent the brace from being withdrawn from said mounting apertures;

said second mounting member being disposed upon the brace at a distance from the first mounting member sufficient to allow the first end of the brace to be placed in the detent receiving aperture in the first mounting member and inserted thereinto to an extent sufficient to allow the second end of the brace to be aligned with and placed in a detent receiving aperture in the second mounting member;

whereby, when said second end of said brace is inserted into the detent receiving aperture in said second mounting member to an extent sufficient for said mounting stop to engage the second mounting member, the first end of the brace is retained within said detent receiving aperture in said first mounting member.

* * * * *